United States Patent [19]

Peugh

[11] Patent Number: 4,798,353

[45] Date of Patent: Jan. 17, 1989

[54] WEB SLITTING SYSTEM AND SLACK INDUCING APPARATUS AND METHOD USEFUL THEREIN

[75] Inventor: Jack Peugh, Marietta, Ga.

[73] Assignee: Printpack, Inc., Atlanta, Ga.

[21] Appl. No.: 10,912

[22] Filed: Feb. 5, 1987

[51] Int. Cl.[4] ..... B65H 23/16

[52] U.S. Cl. ..... 242/75.3; 226/113; 226/114; 242/56.2

[58] Field of Search ..... 242/56.2, 58.1, 56 R, 242/58.3, 75.3, 56.4, 56.5; 226/113, 114, 118, 119

[56] References Cited

U.S. PATENT DOCUMENTS

| | | | |
|---|---|---|---|
| 1,941,597 | 1/1934 | Cavagnaro | 226/114 |
| 3,025,017 | 3/1962 | Wahlstrom | 242/75.3 |
| 3,743,153 | 7/1973 | Moss | 226/113 X |
| 4,702,731 | 9/1987 | Lambrecht et al. | 242/75.3 X |

*Primary Examiner*—Stuart S. Levy
*Assistant Examiner*—Steven M. duBois
*Attorney, Agent, or Firm*—Amster, Rothstein & Ebenstein

[57] ABSTRACT

Apparatus for inducing a controlled quantity of slack in a web traveling along a travel path from a web supply roll to a web slitter comprises first and second supports movable relative to one another. First and second sets of rollers are secured to the first and second supports, respectively, the rollers together defining at least a portion of a travel path for the web from a web supply roll to a web slitter. A control, responsive to an external signal, moves the first and second supports relative to one another a predetermined distance under positive control in such a manner as to effect relative movement of the first and second sets of rollers to vary the length of the travel path.

22 Claims, 6 Drawing Sheets

WEB SLITTING SYSTEM AND SLACK INDUCING APPARATUS AND METHOD USEFUL THEREIN

BACKGROUND OF THE INVENTION

The present invention relates generally to a system for slitting a web, and more particularly to a web slitting system having therein means to simplify the removal of defective portions of the web prior to slitting.

In the packaging industry, it is a common practice to print a packaging design on a web made of a material such as plastic or paper and use the printed web for the outer packaging. It is economical to print a relatively wide web with a design for several packages side by side and then slit the printed web into separate webs which are wound onto rollers and used for separate packaging operations. Sometimes the printed web has another web laminated to it to provide additional strength.

The packager who will be using the printed web wants to avoid making packages with printing defects. Accordingly, it is a common practice in the manufacturing of webs to remove any portion of the web which has a defect prior to the slitting operation. Typically, a first operator visually monitors the printed web right after it has been printed to determine if a defect is present. When the first operator observes a defect, he marks the edge of the web near the defect with a piece of masking tape or the like. This is referred to as "flagging" a defect. Generally, flags are put onto the web forward of the defect. If the printed web is going to have a second web laminated to it, a second operator is needed to observe the flagged defect because the laminating operation would cover the flag (which is on the reverse side of the printed web). After lamination the second operator places a second flag at the edge near the defect. The laminated printed web is wound onto a roll for subsequently slitting in a slitting machine. A third operator observes the laminated printed web as it moves from its roll into the slitting machine and stops the slitting operation when the flag is observed. A significant amount of good salable web is lost by slitter operators who stop the slitting operation at, or even before, a flag and then cut out good material between the flag and the defect, rather than running the slitting operation until the actual defect becomes visible. Alternatively, operators continuing the slitting operation until the defect becomes visible frequently permit a small amount of defective web to pass into the slitting machine before the slitting operation can be stopped. This is a natural result of the limitations of human reaction time and the relatively short distance between the flag and the defect, as well as the various human errors in stopping the system. In order to remove the small amount of defective web run into the slitting machines, it is necessary either to run the web further through the slitting machine and remove the defective web from each of the various slit rolls on which the defective slit web has been wound or to wind the defective web back from the slitting machine and then remove it (the latter alternative requiring several necessary time-consuming preliminaries—for example, the web take-up roll shafts must be raised, the slitter blades must be retracted, the clutch pressure must be reduced, etc.). Both of these techniques for retrieving the defective web from the slitting machine are both time-consuming and web-wasting.

It is estimated that the prior art operations for removing defective portions of a printed web result in a substantial loss of defective-free salable web. In fact, it is estimated that 50% of the web cut out is good and the loss runs about $2.50 per pound. A large commercial operation can have thousands of pounds of waste a year, which represents a significant loss in saleable web.

Thus the need remains for a web slitting system which enables the removal of defective portions of a printed web while wasting only the minimum amount of good salable web and minimizing the downtime for the slitting system while the operator removes the defective portions.

Accordingly, it is an object of the present invention to provide a web slitting system which enables the operator to remove defective web portions while minimizing the loss of good salable defect-free web.

It is another object to provide a web slitting system which enables the operator to remove defective web portions with a minimum of slitter system downtime.

It is a further object to provide a web slitting system which enables the removal of defective web in a manner which minimizes both system downtime and the loss of defect-free web.

Another object of the present invention is to provide slack-inducing apparatus and a slack-inducing method useful in such a web slitting system.

SUMMARY OF THE INVENTION

It has now been found that the above and related objects of the present invention are obtained through the use of apparatus for inducing a controlled quantity of slack in a web traveling along the travel path from a supply roll to a web slitter. As soon as the operator detects the defect indicated by the flag, he halts the normal slitter system and activates a control signal which activates means to reduce the length of a portion of the travel path of the web between the web supply roll and the slitters. This provides the operator with slack in the web, thereby to enable him to rapidly and easily remove the defective portion of the web already unwound from the roll. Because the defective web portion is disposed within the slack-inducing apparatus, well before the slitter blades or the web take-up rolls, the number of time-consuming preliminaries to be performed before removal of the defective web is minimized. Furthermore, because the operator is no longer afraid that the defective web will get into the slitter or web take-up rolls before he can stop the system, he is more likely to allow the defective web portion to run out into the slack-inducing apparatus from which the defective web portion can easily be isolated and removed with minimal loss of defect-free web.

The apparatus comprises first and second support means movable relative to one another, and first and second sets of rollers secured to the first and second support means, respectively. The rollers together define at least a portion of the travel path for the web from a web supply roll to the web slitter. Control means, responsive to an external signal, move the first and second support means relative to one another a predetermined distance under positive control in such a manner as to effect relative movement of the first and second sets of rollers, thereby to vary the length of the travel path.

In a preferred embodiment, the control means comprises a pneumatic cylinder carrying a movable one of the first and second support means, the pneumatic cylinder being capable of moving the movable support means between a first position wherein the first and second support means are closely adjacent and a second position wherein the first and second support means are relatively widely spaced apart. The first position is a slack-inducing position and the second position is a tensioning position which reduces slack. The control means may additionally comprise a second pneumatic cylinder carrying a second movable one of the first and second support means, the second pneumatic cylinder being capable of moving the second movable support means between a first position wherein the first and second support means are closely adjacent and a second position wherein the first and second support means are relatively widely spaced apart. The control means may be responsive to a manual control signal from the system operator and is preferably adapted to produce an increment of slack in the web which is a multiple of the predetermined distance that the first and second support means move closer relative to one another.

Preferably, the first and second sets of rollers have fixed axes of rotation relative to the first and second support means, respectively. Each of the first and second support means may be movable by the control means or one of them may be fixed and the other movable relative thereto. Each of the first and second sets of rollers preferably comprises a plurality of rollers, each roller being an idler.

In one embodiment the first support means is pivotally mounted on the second support means, and the control means induces a relatively greater variation in the travel path length at the end of the apparatus adjacent the web supply roll than at the end relatively distant from the web supply roll.

The process for inducing a controlled quantity of slack in a web traveling along a travel path from a web supply roll to a web slitter comprises the steps of threading the web through first and second sets of rollers so that the rollers together define at least a portion of the travel path of the web from the web supply roll to the web slitter, and, in response to an external control signal, moving the first and second sets of rollers relative to one another under positive control a predetermined distance to vary the length of the travel path and induce slack by shortening the length thereof.

In a preferred embodiment, the first and second sets of rollers are movable relative to one another between a first position wherein the first and second sets of rollers are closely adjacent and a second position wherein the first and second sets of rollers are relatively widely spaced apart. Alternatively, the first set of rollers may be fixed and the second set of rollers movable relative to the first set to vary the length of the travel path.

A web slitting system according to the present invention comprises means for rotatably supporting a supply roll of web to be unwound and slit, means for supporting and rotatively driving take-up rolls for rewinding the web after unwinding and slitting, and means for slitting the unwound web disposed adjacent the take-up roll support means. The system further includes means defining a portion of the travel path for the web from the supply roll support means to the slitting means, including means for varying the length of the travel path portion a predetermined distance and thereby inducing slack in the web.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
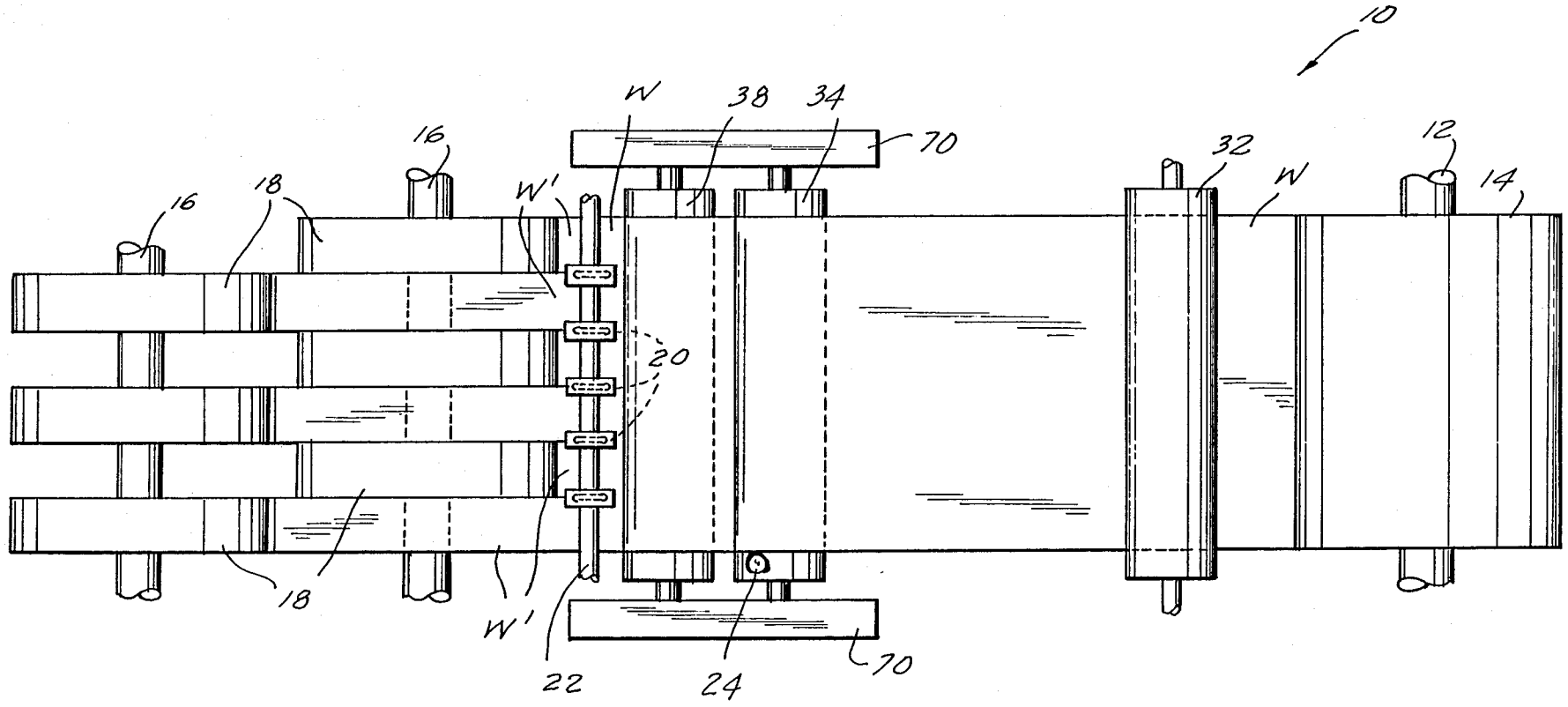
FIG. 1 is a schematic fragmentary top plan view of a slitting system according to present invention.
Figure 2:
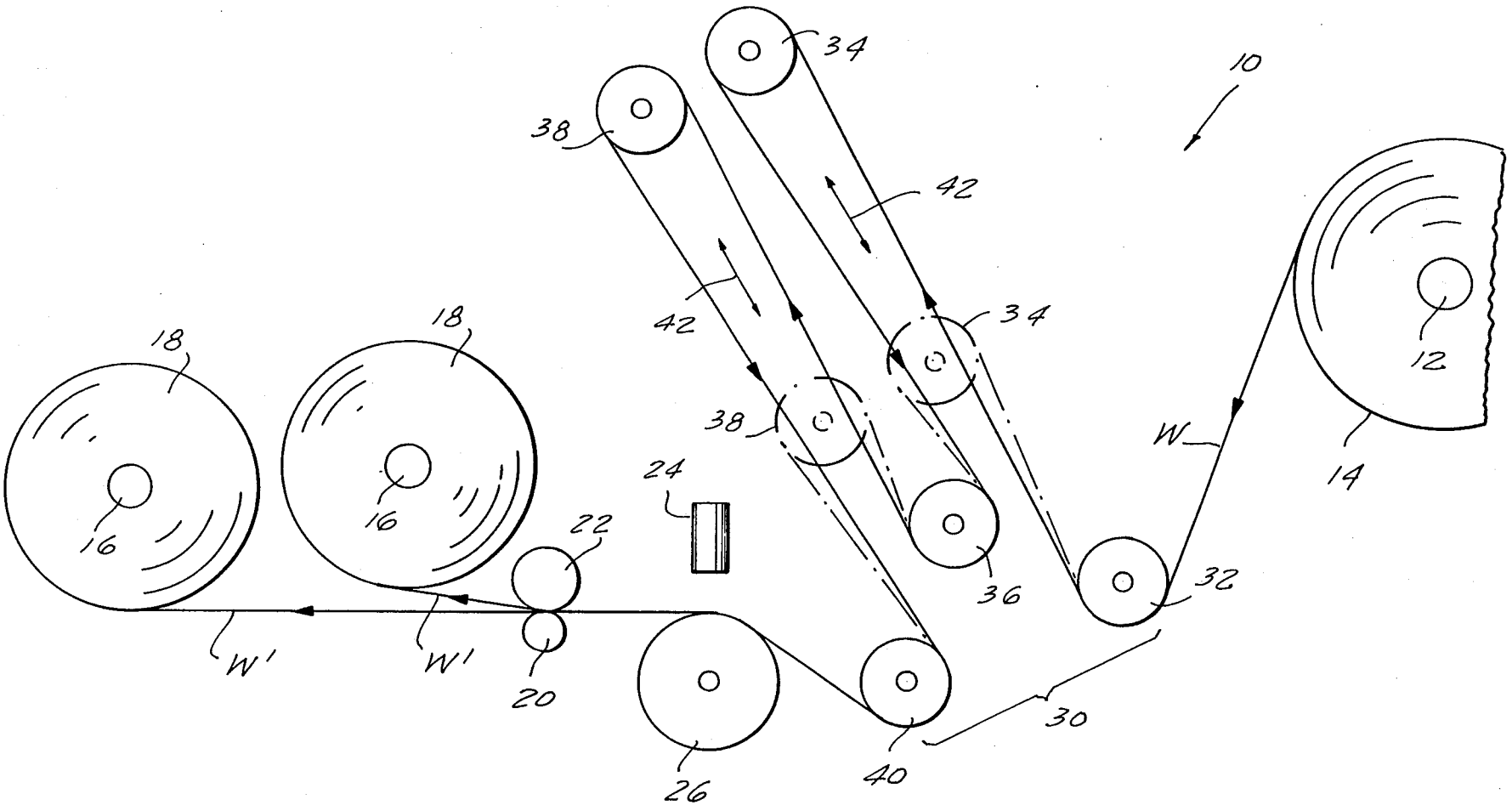
FIG. 2 is a schematic fragmentary side view of the slitting system, the position of the movable rollers of the slack-inducing apparatus during normal operation being shown in solid line and their position during the slack-inducing operation being shown in phantom line.

Referring now to the drawing, and in particular FIGS. 1 and 2 thereof, therein illustrated schematically is a web slitting system according to the present invention, generally designated by the reference numeral 10. In its conventional aspects, the web slitting system 10 includes a shaft 12 for rotatably supporting a supply roll 14 of printed web W to be unwound and slit; driven shafts 16 for supporting and rotatably driving take-up rolls 18 for rewinding the slit webs W′ after unwinding and slitting; and knives 20 disposed adjacent the take-up roll shafts 16 for slitting the unwound web W. The web W on the web supply roll 14 is wide relative to the slit web W′ and typically contains designs for several packages side by side, the designs typically being the same, but not necessarily. The support shaft 12 for the web supply roll 14 is typically an idler which enables the supply roll 14 to rotate freely as the web is drawn through the slitting apparatus and onto the driven take-up rolls 18.

The slitting apparatus comprises a transversely extending series of shaft-mounted knives or slitters 20 disposed in the travel path of the web W adjacent one side thereof, and an idler 22 bearing on the other side of the web W to assure contact between the web and the slitters 20. Slitting systems come in a variety of different layouts—for example, the slitters 20 may be disposed adjacent the lower surface of the web with the idler roll 22 bearing on the upper surface, the slitters may be disposed not in front of the web take-up rolls 18, but rather closely adjacent the rear surface thereof; there may be but a single driven take-up shaft 16, the number and disposition of the take-up rolls 18 may vary, etc. Such variations as well as the many others found in conventional web slitting systems do not affect the operability of the apparatus and method for inducing slack according to the present invention and are to be deemed as encompassed hereby.

It is conventional practice to use an electric eye to serve as a web guide 24 to monitor an edge of the web W, with a feedback system for moving the web to maintain it within a predetermined range of positions so that the slitting operation is also maintained within a predetermined range.

A variety of idler rollers 26 may be positioned throughout the system, as desired, to maintain or modify the direction of web travel. Similarly, a variety of tensioning rollers (not shown) may be positioned throughout the system, as desired, to maintain or modify the degree of tension in the web.

Still referring to FIGS. 1 and 2, the slitting system of the present invention comprises the provision of means, generally designated by the reference numeral 30 (see FIG. 2), for defining a portion of the travel path for the web from the supply roll support means 12 to the slitting means 20. The path defining means 30 includes means for varying the length of the travel path portion a predetermined distance and thereby inducing or reducing slack within the web W. As most clearly shown in FIG. 2, the slack inducing means 30 is comprised of a series of idler rollers 32, 34, 36, 38, and 40 which together act in sequence to define a portion of the web travel path. As indicated by the double-headed arrows 42, the upper rollers 34, 38 are movable between an extended or tension-inducing position shown in solid line and a retracted or slack-inducing position shown in phantom line. The portion of the travel path of the web in the slack-inducing means 30 includes a lower redirecting roller 32 which redirects the web W to an upper roller 34, the web then moving back down and around a middle level center roller 36, which in turn sends the web back up to an upper roller 38, from which it passes downwardly about a lower redirecting roller 40, which finally returns the web to the conventional travel path towards the web guide 24.

A first upper set of rollers comprised of rollers 34, 38 is movable along the axes of arrows 42 towards and away from a fixed lower set of rollers comprised of rollers 32, 36 and 40. Obviously, as the first set of rollers (that is, the rollers 34 and 38) approach the second set of rollers (that is, the rollers 32, 36 and 40), the travel path of the web W is shortened and slack is induced in the web. It will be appreciated that for each unit of distance traveled by the first set of rollers toward the second set of rollers, the slack induced in the web W is 4 units in length. As will become apparent from the description of other embodiments of the present invention, the magnification factor (that is, the increments of slack induced in the web for each increment of motion of the two sets towards one another) is determined by the number and arrangement of the various rollers comprising the slack-inducing apparatus. For example, if the web W is simply threaded about rollers 32, 34 and 40 (thus skipping rollers 36 and 38), the multiplication factor would be only 2, rather than 4.

Figure 3:
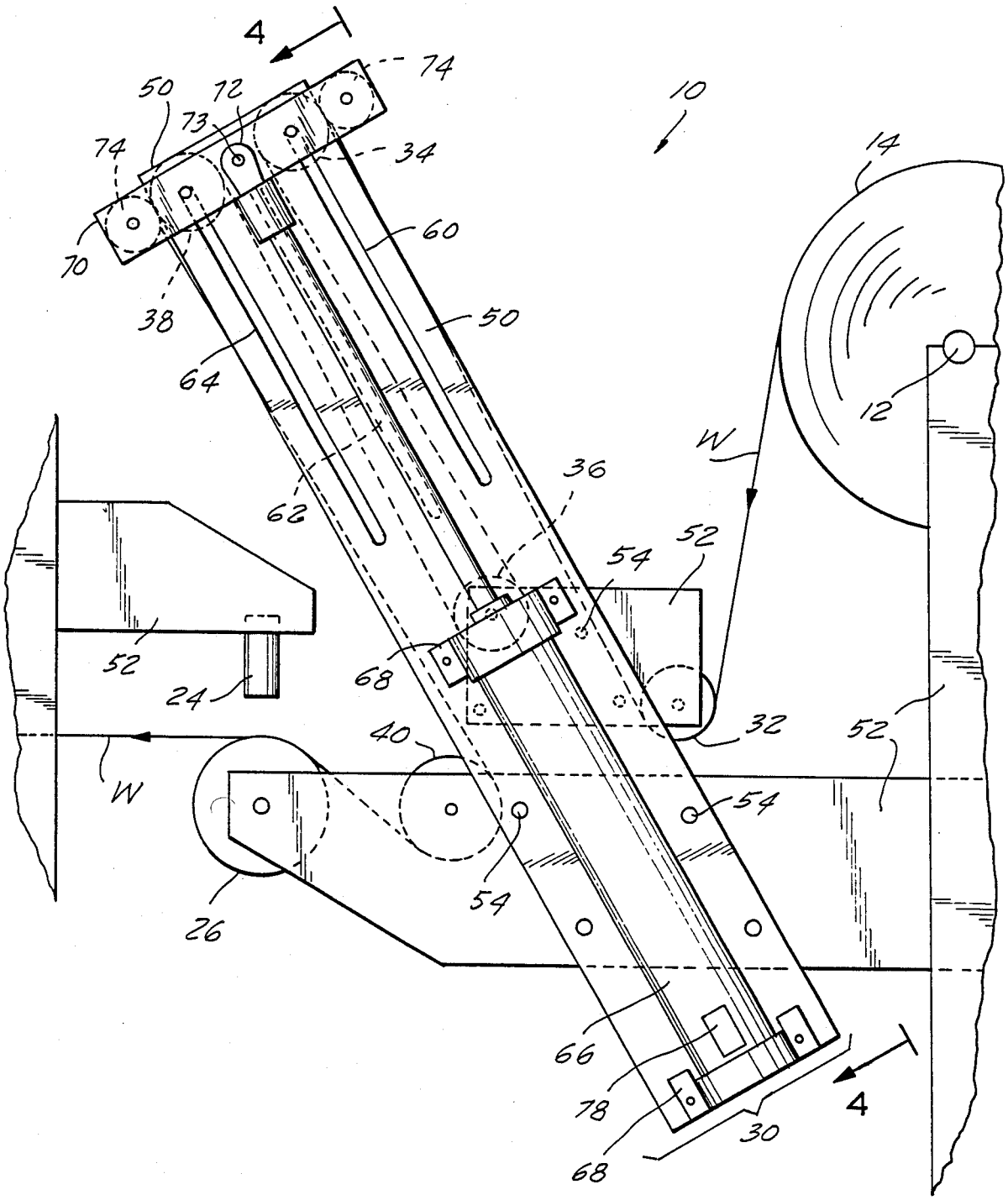
FIG. 3 is a fragmentary side view of the slitting system showing details of the slack inducing apparatus.
Figure 4:
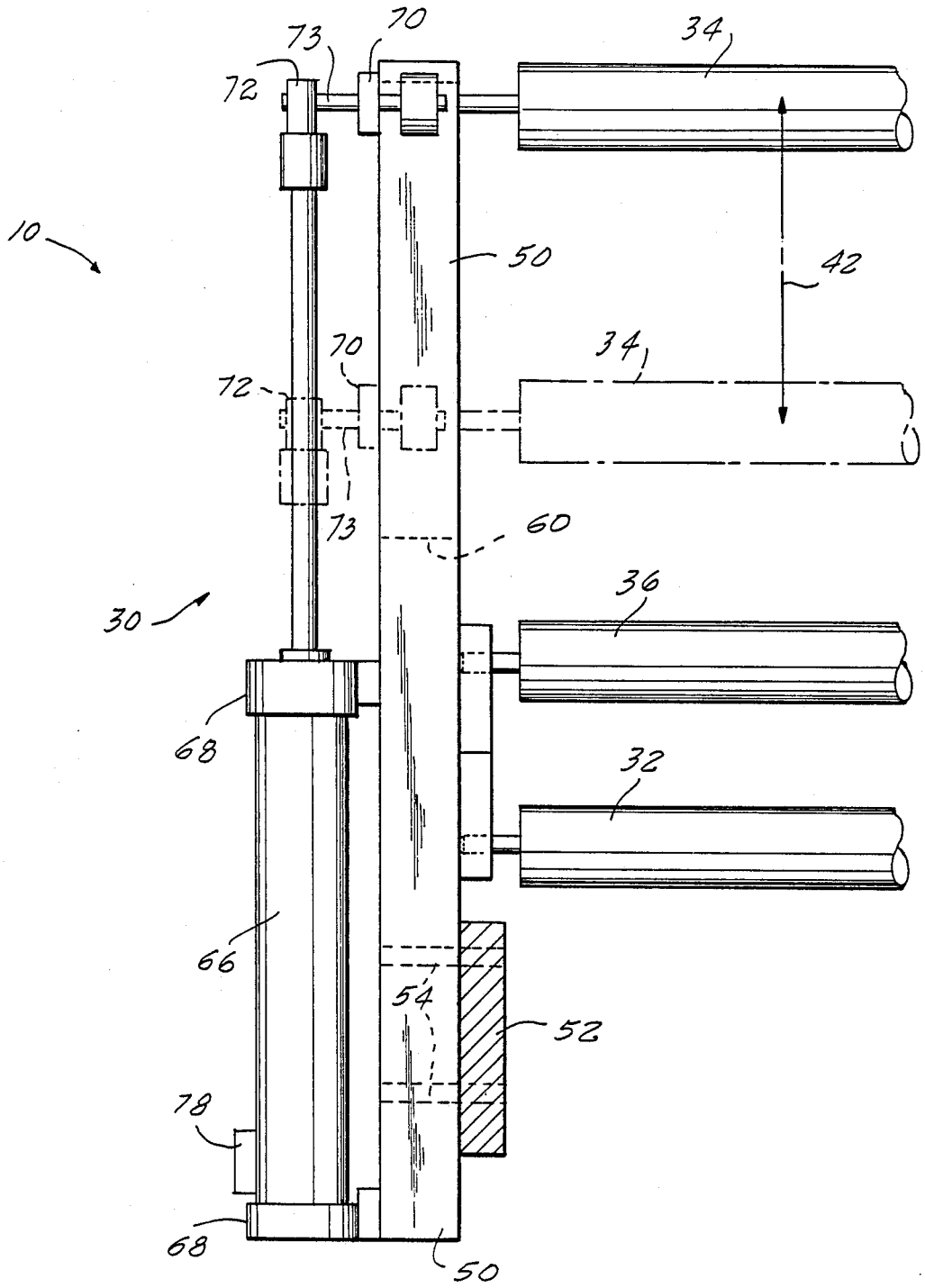
FIG. 4 is a fragmentary view taken along the line 4—4 of FIG. 3 normal to the face of the slack-inducing apparatus, the position of the movable rollers of the slack-inducing apparatus during normal operation being shown in solid line and their position during the slack-inducing operation being shown in phantom line.

Referring now to FIGS. 3 and 4 as well for details of construction of the slack-inducing apparatus 30, the apparatus 30 comprises a fixed framework composed of two frames 50, each frame 50 being securely mounted to a respective side of the slitting system housing 52 at various points 54. It will be appreciated that the redirecting rollers 32, 34 which are shown in FIG. 3 as secured to the slitting system housing 52 are conceptually part of the slack-inducing apparatus 30 and indeed could be mounted thereon instead of upon the housing 52. Roller 36, the intermediate roller of the fixed set of rollers is directly journalled in the frame 50, although it too could be journalled in the housing 52. In other words, so long as the rollers of the fixed set have their axes of rotation fixedly secured to a fixed support, it is not particularly significant whether the rollers of the fixed set are journalled in the fixed frame 50 of the slack-inducing apparatus 30 or in fixed portions of the housing 52 of the slitting system. For reasons which will shortly become apparent, the upper portion of each frame 50 defines three parallel longitudinal slots 60, 62, 64, each slot being closed at both ends. Furthermore, a cylinder 66 of a cylinder/piston assembly is mounted on the outside of each frame 50 by brackets 68, the axis of the cylinder 66 being aligned with the axis of the frame 50. The cylinder 66 is pneumatically driven, although other cylinders, such as liquid-driven cylinders, may also be used.

Disposed on the outer side of the upper portion of each frame 50 is a planar traveling mount 70 of generally rectangular configuration. The shafts of idler rollers 34 and 38 pass through the slots 60, 64, respectively, and are journalled into the mount 70 for travel therewith. The upper end of the piston 72 of the cylinder/piston assembly carries a transverse connecting rod 73 which extends through the mount 70 and the slot 62 of the frame 50. Thus movement of the piston 72 is transmitted to the mount 70 and hence to the idler rollers 34 and 38, thus allowing the mount 70 to slide separately up and down the upper portion of the frame 50. The slots 60, 62 and 64 are preferably slightly shorter than the potential stroke of the piston 72 and hence the travel of the rollers 34 and 38. To reduce wear on the moving parts and on the slots, the mount 70 does not rely upon the slots 60, 62, 64 to define the travel path of the mount 70, but rather provides the mount with two travel guides 74. One travel guide 74 is journalled in the mount 70 with the guide bearing against the front of the frame 50, while the other travel guide 74 is journalled in the mount 70 with the guide bearing against the rear of the frame 50. Thus the brunt of the task of guiding the mount 70 in its travel up and down the upper portion of the frame 50 is assumed by the guides 74 and the sturdy rear and front surfaces of the frame 50.

It will be appreciated that, for the purposes of the slack-inducing apparatus 30, the frames 50 and housing 52 comprise a first fixed support means for the fixed rollers 32, 36 and 40 while the mounts 70 comprises a second support means movable relative to the first support means. Relative movement of the two support means towards each other also moves the two sets of rollers closer together and thus induces slack in the web W. As illustrated in FIGS. 2 and 4, this results in a downward movement of the rollers 34 and 38 associated with the movable support mounts 70 from their upper or extended position (shown in solid line) to their downward or retracted position (shown in phantom line). Conversely, the mounts 70 may be moved upwardly on frames 50 to further separate the mounts 70 and their associated rollers 34, 38 from the lower portion of the frames 50 and their associated rollers 32, 36 and 40, thereby to return the web travel path to its original length for the normal operation of the slitting system. The extension or retraction of the pistons 72 relative to the cylinders 66 is controlled by control means 78, which is in turn responsive to an external signal, typically a manual control signal emitted by the operator of the slitting system.

In operation of the slitting system, an operator (typically positioned upstream or behind the web supply roll 14) visually monitors a web W unwinding from the web supply roll 14 and entering the slack-inducing apparatus 30 on the way downstream to the slitting means 20 and web take-up rolls 18. As soon as the operator observes a defect, he acts to shut down the slitting system. Due to the slowness of human reaction time and the inertia of the various components of the slitting system, the defective portion of the web W associated with the flag is usually beyond the redirecting roller 32 and somewhere within the slack-inducing apparatus 30. Assuming that the slack-inducing apparatus 30 is appropriately selected for the particular slitting system, the defective web portion should not yet have reached the slitting means 20. The operator then has only to activate the control means 78—for example, by means of a manual control signal—to cause the piston 72 to retract within the cylinder 66, thereby bringing the upper set of rollers 34, 38 closer to the lower set of rollers 34, 36, and 40, and thereby producing slack in the web W. Assuming that the travel of the piston is about one foot, this results in about 4 feet of slack in the web, enough to enable the operator to easily delineate the defect and remove only the portion of the web necessary. After the defective portion of the web has been removed, the two ends of the web produced by the removal are joined together in accordance with conventional web slitting practice. Additional web material may be easily unwound from the supply roll 14 by the operator, as necessary to allow joining together of the web ends and to facilitate return of the mount 70 and its associated rollers 34, 38 to their original position without causing excessive tension on the web.

Figure 5:
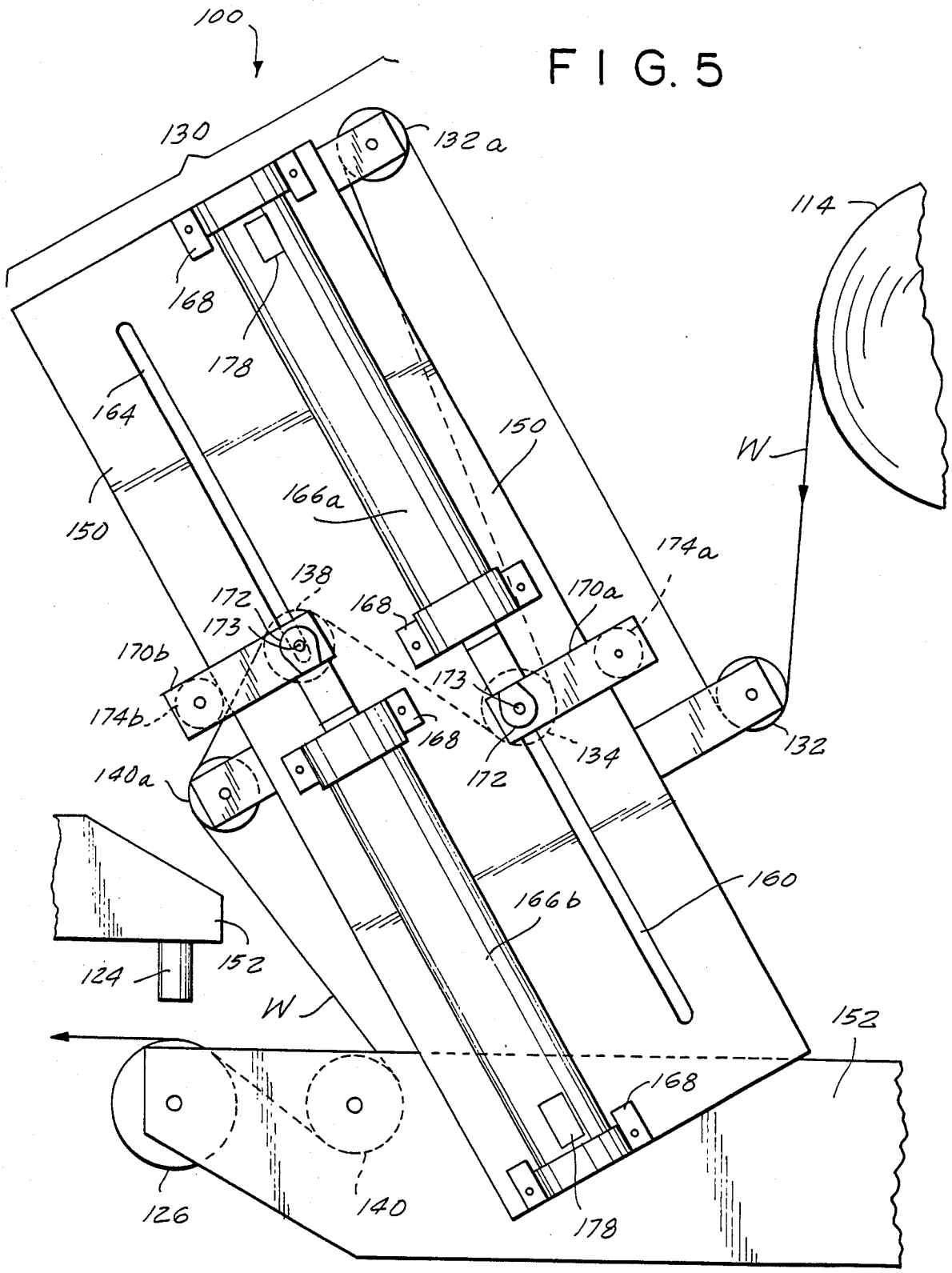
FIG. 5 is a fragmentary side elevation view of a slitting system embodying a second embodiment of the slack-inducing apparatus.

Referring now to FIG. 5, therein illustrated is a web slitting system 100 incorporating a second embodiment 130 of the slack-inducing apparatus of the present invention. Elements in this system 100 corresponding to like elements in the web slitting system 10 are identified by a corresponding three-digit number in the 100 series.

The slack-inducing apparatus 130 utilizes two cylinder/piston assemblies **166*a* and 166*b*, the two cylinders being oppositely directed, in offset but parallel alignment. The first cylinder 166*a* controls the position of idler roller 134 within the slot 160, while the second cylinder 166*b* controls the position of the idler roller 138 within the slot 164. During normal operation of the slitting system the rollers 134, 138 will be at the far ends of the slots 160, 164, respectively, from their controlling cylinders 166*a*, 166*b*, respectively. When actuated by the control means 178, however, the cylinders 166*a*, 166*b* cause their pistons 172, connecting rods 173, mounts 170*a*, 170*b*, and rollers 134, 138 to retract along the slots 160, 164, respectively, to the postion shown in FIG. 5, thereby inducing slack in the web W. Mounts 170*a*, 170b, are connected to the movable rollers 134, 138, respectively, and carry guide wheels 174*a*, 174*b*, respectively. There are two redirecting idler rollers 132, 132*a* on the upstream or input face of the frame 150 and two redirecting rollers 140, 140*a* on the downstream or output face of the frame 150**.

An obvious economic disadvantage of the second embodiment, relative to the first embodiment, is that the second embodiment requires twice the number of cylinder/piston assemblies for each slack-inducing apparatus, four as opposed to only two in the first embodiment. The multiplication factor for the second embodiment is the same as for the first embodiment—namely, 4.

It will be appreciated that in the second embodiment the first set of rollers is comprised of the roller 134 mounted on the movable support means **170*a*, and the second set of rollers is comprised of the roller 138 mounted on another movable support means 170*b*. Despite this functional difference, it remains true that the rollers are in a slack-inducing position when the various support means 170*a*, 170*b* are closely adjacent and in a tensioning position when the various support means 170*a*, 170*b* are relatively widely spaced apart. Alternatively, if preferred, the second embodiment 130 of the slack-inducing apparatus may be viewed as conceptually comprised of a first movable set of rollers 134 and 138 secured to movable supports 170*a* and 170*b* and a second fixed set of rollers 132, 132*a*, 140, 140*a* mounted on fixed support means 150, 152**.

Figure 6:
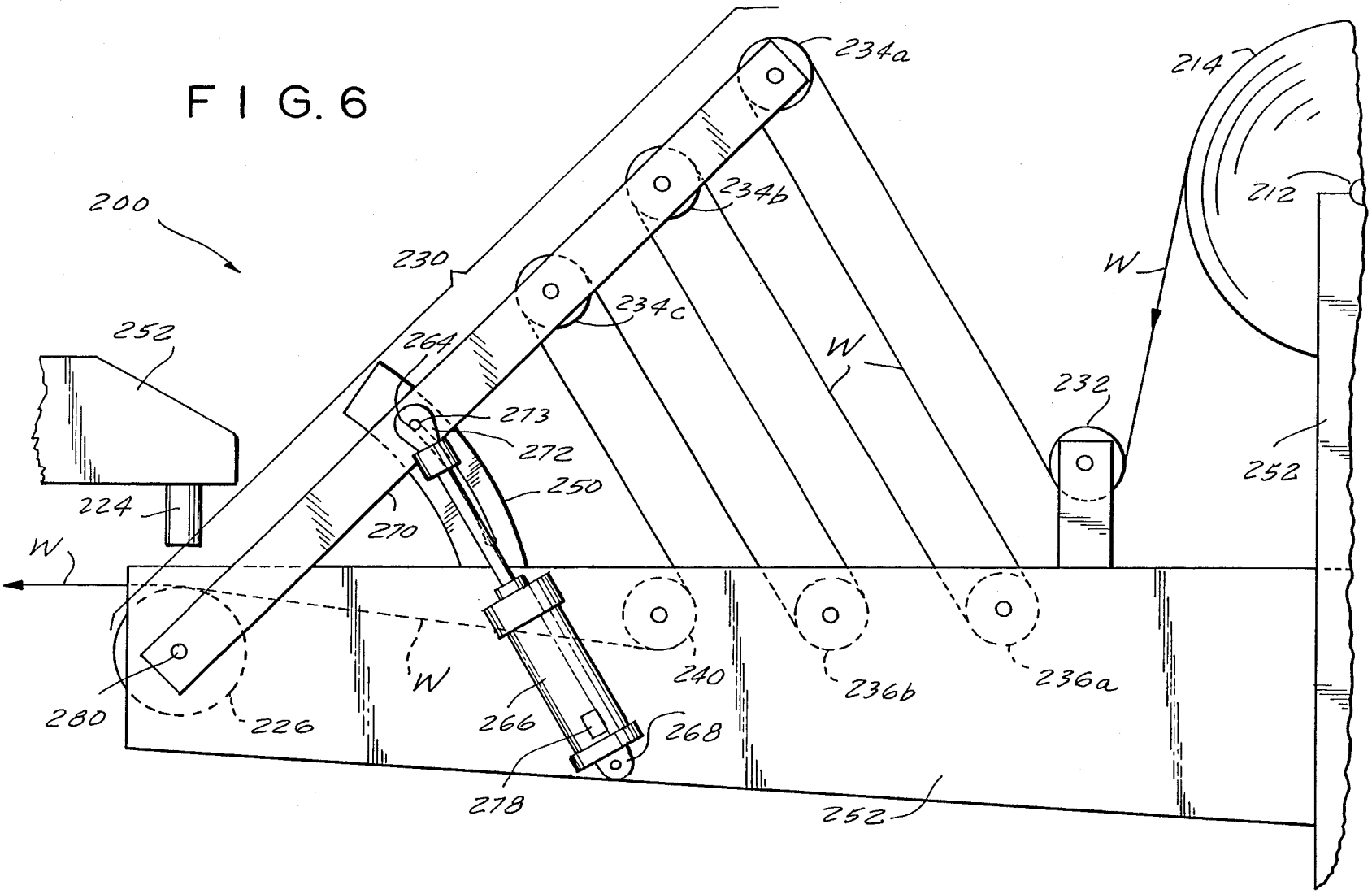
FIG. 6 is a fragmentary side elevation view of a slitting system embodying a third embodiment of the slack-inducing apparatus.

Referring now to FIG. 6, therein illustrated is a web slitting system 200 incorporating a third embodiment 230 of the slack-inducing apparatus of the present invention. Elements in this system 200 corresponding to like elements in the web slitting system 10 have been correspondingly numbered with a three-digit numbers in the 200 series.

In the third embodiment 100, the fixed support means is the slitting system housing 252 and the movable support means is a lever arm or mount 270 pivotally mounted on the housing 252 at a pivot point 280. Journalled in the mount 270 for rotation along axes perpendicular thereto are the idler rollers **234*a*, 234*b*, 234*c*. These rollers 234*a*, *b* and *c* are mounted on the free end of the lever arm 270 for pivotal movement therewith about the pivot point 280. The set of fixed rollers comprise redirecting roller 232 at the upstream or input side, two lower rollers 236*a* and 236*b*, and a downstream or output side redirecting roller 240. The web W from the supply roll 214 passes around the fixed redirecting roller 232, is then threaded around movable upper roller 234*a* down to fixed roller 236*a*, up to movable roller 234*b*, down to fixed roller 236*b*, up to movable roller 234*c*, and back down to fixed redirecting roller 240**, from whence it proceeds back to its normal travel path.

Movement of the lever arm or mount 270 from the extended or tensioning position illustrated in FIG. 6 down to a slack-inducing position (i.e., a more horizontal orientation closer to the fixed rollers **236*a*, 236*b*) is controlled, as in the other embodiments, by a cylinder/-piston assembly (here mounted on the housing 252 by a pivotable bracket 268) acting under the guidance of a control means 278. The cylinder/piston assembly is preferably oriented somewhere between the vertical and a normal to the mount axis when mount 270 is in its normal or tensioning position. A small frame 250 (which may simply be an upward projection of the housing 252 on which the cylinder 266 is mounted) defines an arcuate slot 264, the piston 272 carrying a transverse connecting rod 273 extending through the mount 270 and into the slot 264. This arrangement permits the cylinder/piston assembly to pivot relative to the mount 270** as the mount moves between its extended and retracted positions.

While the multiplication factor of the third embodiment 230 cannot be easily determined, clearly it can be easily increased, as desired, by the addition of appropriate rollers 234 on the mount 270 and additional rollers 236 on the housing 252. The production of slack in the web is concentrated at the end of the slack-inducing apparatus adjacent the web supply roll 214 rather than at the end distant from the web supply roll 214 and adjacent the web guide 224.

It will be appreciated that in each embodiment the control means 78, 178, 278 may be designed to produce a maximum production of slack (that is, full movement of the movable support means to its retracted position) for each activation of the manual control signal by the operator or to permit inducement of an intermediate level of slack (that is, only limited movement of the movable support means towards its retracted position) proportional to the duration of activation of the manual control signal by the operator.

To summarize, the web slitting system of the present invention incorporates a slack-inducing apparatus which enables the removal of defective web in a manner which minimizes both system downtime and the loss of defect-free web.

Now that the preferred embodiments of the present invention have been shown and described in detail, various modifications and improvements thereon will become readily apparent to those skilled in the art. Accordingly, the spirit and scope of the present invention is to be construed broadly according to the appended claims, and not by the foregoing specification of the preferred embodiments.

What is claimed is:

1. Apparatus for inducing a controlled quantity of slack in a web travelling along a travel path from a web supply roll to a web slitter, comprising:

(A) first and second support means movable relative to one another;

(B) first and second sets of rollers secured to said first and second support means, respectively, said first set of rollers remaining at all times to one side of said second set of rollers, said rollers together defining at least a portion of a travel path for the web from a web supply roll to a seb slitter; and (C) control means responsive to an external signal for moving each of said first and second support means relative to one another a predetermined distance under positive control in such a manner as to effect relative movement of said first and second sets of rollers, thereby to vary the length of said travel path and induce slack by shortening the length thereof.

2. The apparatus of claim 1, wherein said rollers are idler rollers.

3. The apparatus of claim 1 wherein said first and second sets of rollers have fixed axes of rotation relative to said first and second support means, respectively.

4. The apparatus of claim 1, wherein said control means comprises a fluid-driven cylinder carrying a movable one of said first and second support means, said cylinder being capable of moving said movable support means between a first position wherein said first and second support means are closely adjacent and a second position wherein said first and second support means are relatively widely spaced apart.

5. The apparatus of claim 4, wherein said first position is a slack-inducing position and said second position is a tensioning position which reduces slack.

6. The apparatus of claim 4, wherein said control means additionally comprises a second cylinder carrying a second movable one of said first and second support means, said second cylinder being capable of moving said second movable support means between a first position wherein said first and second support means are closely adjacent and a second position wherein said first and second support means are relatively widely spaced apart.

7. The apparatus of claim 1, wherein each of said first and second sets of rollers comprises a plurality of rollers.

8. The apparatus of claim 1, wherein said control means is responsive to a manual control signal.

9. The apparatus of claim 1, wherein said control means is adapted to produce a quantity of slack in the web which is greater than the predetermined distance that said first and second support means move closer relative to one another.

10. The apparatus of claim 1 wherein said relative movement of said first and second sets of rollers is independent of any tension in the web or the absence thereof.

11. The apparatus of claim 1 wherein said control means maintain at least one of said first and second sets of rollers in essentially constant contact with the web.

12. The apparatus for claim 1 wherein said control means moves said first and second support means relative to one another under positive control between a first fixed orientation and a second fixed orientation.

13. The apparatus of claim 1 wherein said control means moves said first and second support means relative to one another a predetermined distance under positive control both closer together and farther apart.

14. A process for inducing a controlled quantity of slack in a web traveling along a travel path from a web supply roll to a web slitter comprising the steps of:

(A) threading the web through first and second sets of rollers so that the rollers together define at least a portion of the travel path of the web from the web supply roll to the web slitter; and (B) in response to an external control signal, moving each of the first and second sets of rollers relative to one another under positive control a predetermined distance to vary the length of the travel path and induce slack by shortening the length thereof, said first set of rollers remaining at all times to one side of said second set of rollers.

15. The process of claim 14, wherein said first and second sets of rollers are moved relative to one another between a first position wherein the first and second sets of rollers are closely adjacent and a second position wherein the first and second sets of rollers are relatively widely spaced apart.

16. The process of claim 14, wherein the movement of the first and second sets of rollers relative to one another is in response to a manually induced control signal.

17. A web slitting system comprising:

(A) means for rotatably supporting a supply roll of web to be unwound and slit;

(B) means for supporting and rotatively driving take-up rolls for rewinding the web after unwinding and slitting;

(C) means for slitting the unwound web disposed adjacent said take-up roll support means; and (D) means defining a portion of a travel path for the web from said supply roll support means to said slitting means, including means for varying the length of said travel path portion a predetermined distance and thereby induce a controlled quantity of slack in the web; said means for varying the length of said travel path portion comprising:

(i) first and second support means movable relative to one another;

(ii) first and second sets of rollers secured to said first and second support means, respectively, said first set of rollers remaining at all times to one side of said second set of rollers; and (iii) control means responsive to an external signal for moving each of said first and second support means relative to one another a predetermined distance under positive control in such a manner as to effect relative movement of said first and second sets of rollers to vary the length of said travel path portion.

18. The apparatus of claim 17, wherein said first and second sets of rollers have fixed axes of rotation relative to said first and second support means, respectively.

19. The apparatus of claim 17, wherein said control means comprises a fluid-driven cylinder carrying a movable one of said first and second support means, said cylinder being capable of moving said movable support means between a first position wherein said first and second support means are closely adjacent and a second position wherein said first and second support means are relatively widely spaced apart.

20. The apparatus of claim 17, wherein said control means is responsive to a manual control signal.

21. Apparatus for inducing a controlled quantity of slack in a web travelling along a travel path from a web supply roll to a web slitter, comprising:

(A) first and second support means movable relative to one another;

(B) first and second sets of rollers secured to said first and second support means, respectively, said rollers together defining at least a portion of a travel path for the web from a web supply roll to a web slitter; and (C) control means responsive to an external signal for moving each of said first and second support means relative to one another a predetermined distance under positive control in such a manner as to effect relative movement of said first and second sets of rollers, thereby to vary the length of said travel path.

22. The apparatus of claim 21, wherein said control means comprises first and second fluid-driven cylinders carrying said first and second support means, respectively, said cylinders being capable of moving said carried support means between a first position wherein said first and second support means are closely adjacent and a second position wherein said first and second support means are relatively widely spaced apart.

* * * * *